US007500872B2

(12) United States Patent
Takahashi et al.

(10) Patent No.: US 7,500,872 B2
(45) Date of Patent: Mar. 10, 2009

(54) CONNECTOR

(75) Inventors: Shinji Takahashi, Niwa-gun (JP); Yoshiaki Kato, Niwa-gun (JP); Harehide Sasaki, Niwa-gun (JP); Katsumasa Matsuoka, Niwa-gun (JP); Hiroshi Kobayashi, Okazaki (JP)

(73) Assignee: Kabushiki Kaisha Tokai-Rika-Denki-Seisakusho, Aichi-ken (JP)

( * ) Notice: Subject to any disclaimer, the term of this patent is extended or adjusted under 35 U.S.C. 154(b) by 0 days.

(21) Appl. No.: 11/778,167

(22) Filed: Jul. 16, 2007

(65) Prior Publication Data

US 2008/0020607 A1 Jan. 24, 2008

(30) Foreign Application Priority Data

Jul. 18, 2006 (JP) ..... 2006-195630

(51) Int. Cl.
*H01R 13/60* (2006.01)

(52) U.S. Cl. ..... 439/567

(58) Field of Classification Search ..... 439/78, 439/567, 570, 571, 572, 563, 892
See application file for complete search history.

(56) References Cited

U.S. PATENT DOCUMENTS 5,613,877 A * 3/1997 Patel et al. ..... 439/567
5,697,812 A * 12/1997 Sampson et al. ..... 439/567
5,908,329 A * 6/1999 Chen et al. ..... 439/567
5,938,473 A 8/1999 Nishio et al.
5,984,722 A 11/1999 Ito
6,454,599 B1 * 9/2002 Wu ..... 439/567
6,572,404 B1 * 6/2003 Wu ..... 439/567
6,629,857 B1 * 10/2003 Ma et al. ..... 439/567

FOREIGN PATENT DOCUMENTS

JP 2002-151911 A 5/2002

* cited by examiner

*Primary Examiner*—Neil Abrams
*Assistant Examiner*—Phuong Nguyen
(74) *Attorney, Agent, or Firm*—Roberts Mlotkowski Safran & Cole, P.C.; Thomas W. Cole

(57) ABSTRACT

This connector comprises: a connector main body mounted on a substrate; a latching piece that is attached to the connector main body and which temporarily joins the connector main body to the substrate by temporarily latching to an edge portion of an attachment hole formed in the substrate; and a rib having a width wider than the latching piece and which is attached to the connector main body. The rib is inserted into the attachment hole, and when external force in a direction of moving away from the substrate acts on one end side of the connector main body, whose end portions in the width direction interfere with the interior peripheral portion of the attachment hole, so as to generate resistance force that resists the external force.

5 Claims, 3 Drawing Sheets

CONNECTOR

CROSS-REFERENCE TO RELATED APPLICATION

This application claims priority under 35 USC 119 from Japanese Patent Application No. 2006-195630, the disclosure of which is incorporated by reference herein.

BACKGROUND OF THE INVENTION

1. Field of the Invention

The present invention relates to a connector that is mounted on a substrate.

2. Description of the Related Art

Among conventional connectors, there are devices that are configured so that a connector main body is mounted on a substrate by soldering a fixing clasp, which is attached to the connector main body, to the substrate. (For example, see the Official Gazette of JP-A No. 2002-151191.) This type of fixing clasp is configured so that components such as a pair of latching pieces is provided thereon, and these latching pieces are inserted into attachment holes formed in the substrate. These latching pieces latch to (i.e., catch on) the edge portions of the attachment holes. For this reason, even in a state prior to the fixing clasp (i.e., pair of latching pieces) being soldered to the substrate, the connector main body can be temporarily joined to the substrate.

Nonetheless, in cases such as when external force acts upon the connector main body in the above-described state of temporary joining, the latching pieces sometimes deforms and the above-described temporary joining capability can be lost.

SUMMARY OF THE INVENTION

The present invention was made to solve the above-described problems, and in order to achieve this goal a first aspect relates to a connector comprising: a connector main body mounted on a substrate; a latching piece that is attached to the connector main body and which temporarily joins the connector main body to the substrate by temporarily latching to an edge portion of an attachment hole formed in the substrate; and a rib having a width wider than the latching piece and which is attached to the connector main body, and which is inserted into the attachment hole, and when external force in a direction of moving away from the substrate acts on one end side of the connector main body, whose end portions in the width direction interfere with the interior peripheral portion of the attachment hole, so as to generate resistance force that resists the external force.

In the connector of the first aspect, the latching piece attached to the connector main body is caught on the edge portion of the attachment hole in the substrate, whereby the connector main body is temporarily fixed to the substrate. Also, the rib attached to the connector main body is formed wider than the latching piece and inserted into the attachment hole of the substrate. When external force acts on one end side of the connector main body in a direction away from the substrate, the ends of the rib in the widthwise direction interfere with the inner peripheral portion of the attachment hole and generate resistance force that resists the external force. Accordingly, movement away from the substrate of the connector main body is controlled and deformation of the latching piece can be suppressed.

A second aspect for achieving the above-stated goal relates to a connector comprising: a connector main body mounted on a substrate; a latching piece that is attached to the connector main body and which temporarily joins the connector main body to the substrate by temporarily latching to an edge portion of an attachment hole formed in the substrate; and a rib that is attached to the connector main body, is inserted into the attachment hole, and deforms and latches with the latching piece when external force of a preset value or greater in a direction that moves toward the latching piece by itself is applied.

In the connector according to the second aspect, the latching piece attached to the connector main body is caught on the edge portion of the attachment hole of the substrate, whereby the connector main body is temporarily held to the substrate. Also, the rib attached to the connector main body is inserted into the attachment hole of the substrate. When external force of a preset value or more toward the latching piece side is applied to the rib, the rib deforms and latches with the latching piece. Due to this, deformation of the latching piece can be suppressed.

The third aspect for achieving the above goal relates to the connector of the second aspect, wherein the rib is formed so that the width thereof is wider than the latching piece.

DESCRIPTION OF THE PREFERRED EMBODIMENTS

1. First Exemplary Embodiment

A connector 10 according to an exemplary embodiment of the present invention is described based on FIGS. 1A-3. Hereinafter, for the sake of convenience, the explanations will be given where a direction shown by an arrow 'A' in each drawing is referred to 'the front direction', a direction shown by an arrow 'B' is referred to 'the upward direction', and a direction perpendicular to the paper surface and closer to the viewer is referred to 'the left direction'.

Figure 1A:
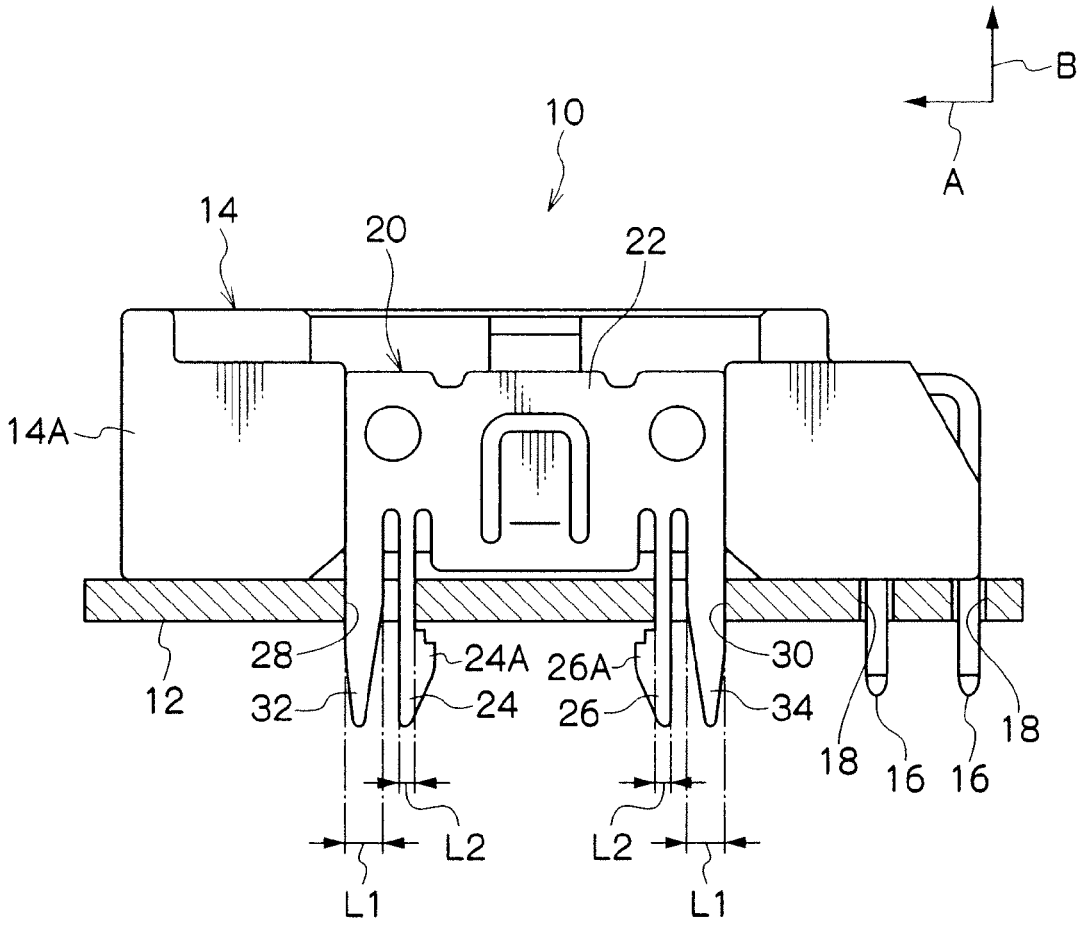
FIG. 1A is a partial cross-sectional drawing showing a state where a connector according to a first exemplary embodiment is attached to a substrate.

As shown in FIG. 1A, the connector 10 is a so-called through-hole type connector that is mounted on a substrate 12 (e.g., a print wiring substrate with a land formed by a method such as screen printing method), and has a connector main body 14. The front side of the connector main body 14 is formed into a box shape that opens and plural terminals 16 are attached to the interior of the connector main body 14. These plural terminals 16 protrude towards the rear side of the connector main body 14 and are bent towards the bottom side, and are inserted through the insides of connection holes 18 formed in the substrate 12. Lands not shown in the drawings are formed at the edge portions of each of the connection holes 18 in the substrate 12. Each terminal 16 is configured to be soldered to these lands.

A fixing clasp 20 is attached to left and right side walls 14A of the connector main body 14 (only the side wall 14A of the left side is shown in FIG. 1A) for fixing the connector main body 14 to the substrate 12. The fixing clasp 20 is formed symmetrically at both sides in the front and rear directions, and has a main body 22 formed into a short flat board shape. Both end portions in the front and rear directions of the main body 22 (in FIG. 1A, both end portions in the left and right directions) are fit into grooves (not shown) formed in the side walls 14A of the connector main body 14, whereby the main body 22 is attached to the connector main body 14. Consequently, relative movement of the main body 22 towards the bottom side of the connector main body 14 is restricted.

Figure 1B:
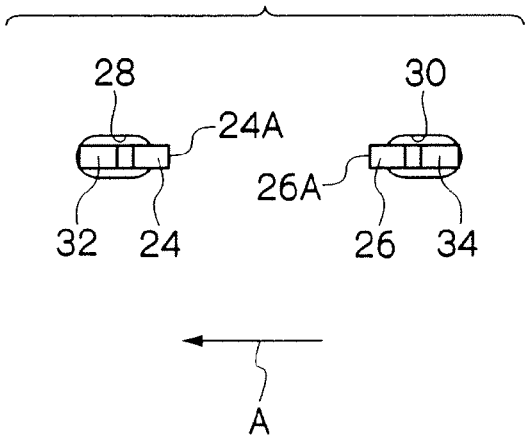
FIG. 1B is an explanatory drawing showing a latching relation between a force-receiving rib and a latching piece of the connector, and attachment holes that is formed on the substrate and through which the force-receiving rib and the latching piece are inserted, when the connector according to the first exemplary embodiment is attached to the substrate.
Figure 2:
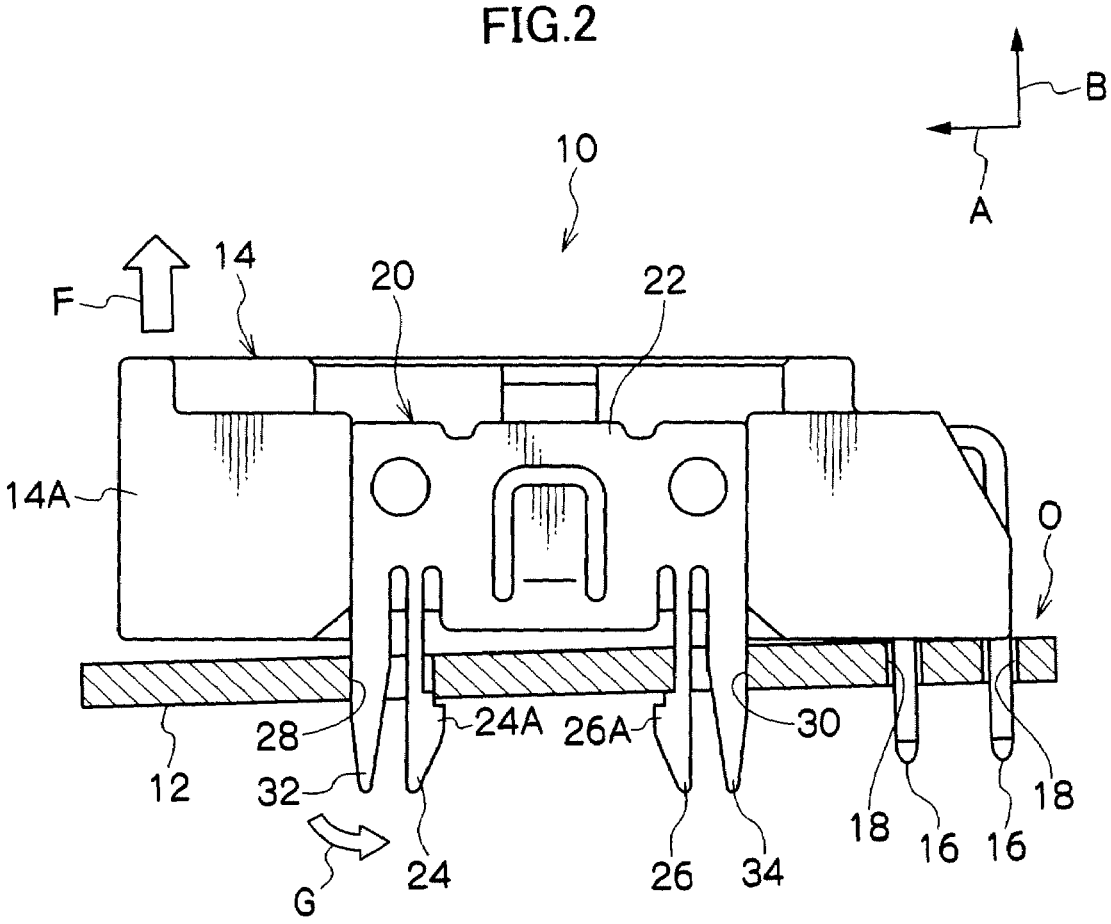
FIG. 2 is a cross-sectional drawing showing a state where external force in a direction of moving away from the substrate is applied to a front end side of the connector main body of the connector according to the first exemplary embodiment.

Latching pieces 24 and 26 are integrally provided at both ends in the front and rear directions with respect to the main body 22. The latching pieces 24, 26 are formed into long square bar forms that extend downward, and respectively inserted into attachment holes 28 and 30 formed on the substrate 12 so as to penetrate through the substrate 12. Each of the attachment holes 28, 30 is formed as a long hole extending along the front and rear directions of the substrate 12. As shown in FIG. 1B, latching piece 24 that is provided at the end in the front side of the main body 22 latches with the inner peripheral surface of the rear side of the attachment hole 28, and the latching piece 26 that is provided at the end in the rear side of the main body 22 latches with the inner peripheral surface of the front side of the attachment hole 30. Lands not shown in the drawing are formed on the substrate 12 at the edge portions of the attachment holes 28, 30 and the latching pieces 24, 26 are soldered to these lands, whereby the fixing clasp 20 and the connector main body 14 are fixed (i.e., mounted) to the substrate 12.

Further, as shown in FIGS. 1A and 1B, a claw 24A that protrudes toward the rear end of the main body 22 is formed on the tip portion of the latching piece 24 provided at the front end of the main body 22. The claw 24A is formed to be caught on the edge portion of the rear side of the attachment hole 28. Further, a claw 26A that protrudes toward the front end of the main body 22 is formed on the tip portion of the latching piece 26 provided at the rear end of the main body 22. The claw 26A is formed to be caught on the edge portion of the front side of the attachment hole 30. Thus, even before the latching pieces 24, 26 are soldered to the lands (not shown) of the substrate 12, the connector main body 14 is temporarily joined to the substrate 12 by the latching pieces 24, 26 (i.e., by the fixing clasp 20).

In addition, when the latching pieces 24, 26 are inserted into the attachment holes 28, 30, the inclined surfaces provided on the latching pieces 24, 26 at the end sides thereof rub against the edge portions of the attachment holes 28, 30, whereby the latching pieces 24, 26 flex in directions moving away from each other. When the latching pieces 24, 26 reach preset attaching positions, the latching pieces 24, 26 elastically rebound and the claws 24A, 26A are caught on the edge portions of the attachment holes 28, 30.

Further, in the connector 10, at both end portions of the fixing clasp 20 in the front and rear directions, force-receiving ribs 32 and 34 are provided integrally. The force-receiving ribs 32, 34 act as ribs in the connector of the present invention. The force-receiving ribs 32, 34 are formed into long board shapes, they extend out toward the bottom, are respectively inserted into the attachment holes 28 and 30 of the substrate 12, and thus, penetrate through the substrate 12. Also, as shown in FIG. 1B, the force-receiving rib 32 provided at the front end side of the main body 22 latches with the inner peripheral surface of the front portion of the attachment hole 28, and the force-receiving rib 34 provided at the rear end side of the main body 22 latches with the inner peripheral surface of the rear portion of the attachment hole 30.

The width measurements L1 of the base ends of the force-receiving ribs 32, 34 are formed to be larger than the width measurements L2 of the base ends of the latching pieces 24, 26. Therefore, the force-receiving ribs 32, 34 are configured to be less flexible in the front and rear directions compared with the latching pieces 24, 26. Any portions such as claw portions protruding in the front and rear directions are not provided on neither of the force-receiving ribs 32 and 34, and accordingly, the force-receiving ribs 32, 34 are not necessarily formed so as to flex when the force-receiving ribs 32, 34 is inserted into the attachment holes 28, 30.

Additionally, the width measurements of the tip sides of the force-receiving ribs 32, 34 are formed to be thinner than the width measurement L1 of the base ends thereof (i.e., the tip end sides are sharper than the base ends thereof) so as to be easily inserted into the attachment holes 28, 30.

In the connector 10, in the state of the above-described temporary joining, when external force F (see FIG. 2) of a direction of moving away from the substrate 12 is applied to the front end side (one end side) of the connector main body 14, the connector main body 14 rotates relatively to the substrate 12 with the lower corner portion of the rear end side (the part in FIG. 2 assigned with the 'O' symbol) as a point of support, and whose end portions in the width direction of the force-receiving rib 32 interferes with the inner peripheral surface at the front side of the attachment hole 28. For this reason, external force G is applied to the force-receiving rib 32 toward the rear side (i.e., the side of the latching piece 24) and since the force-receiving rib 32 is formed so as to not be prone to flex in the front and rear directions, a resistance force against the external force G and external force F is generated due to the interference between the force-receiving rib 32 and the inner peripheral surface of the attachment hole 28.

Figure 3:
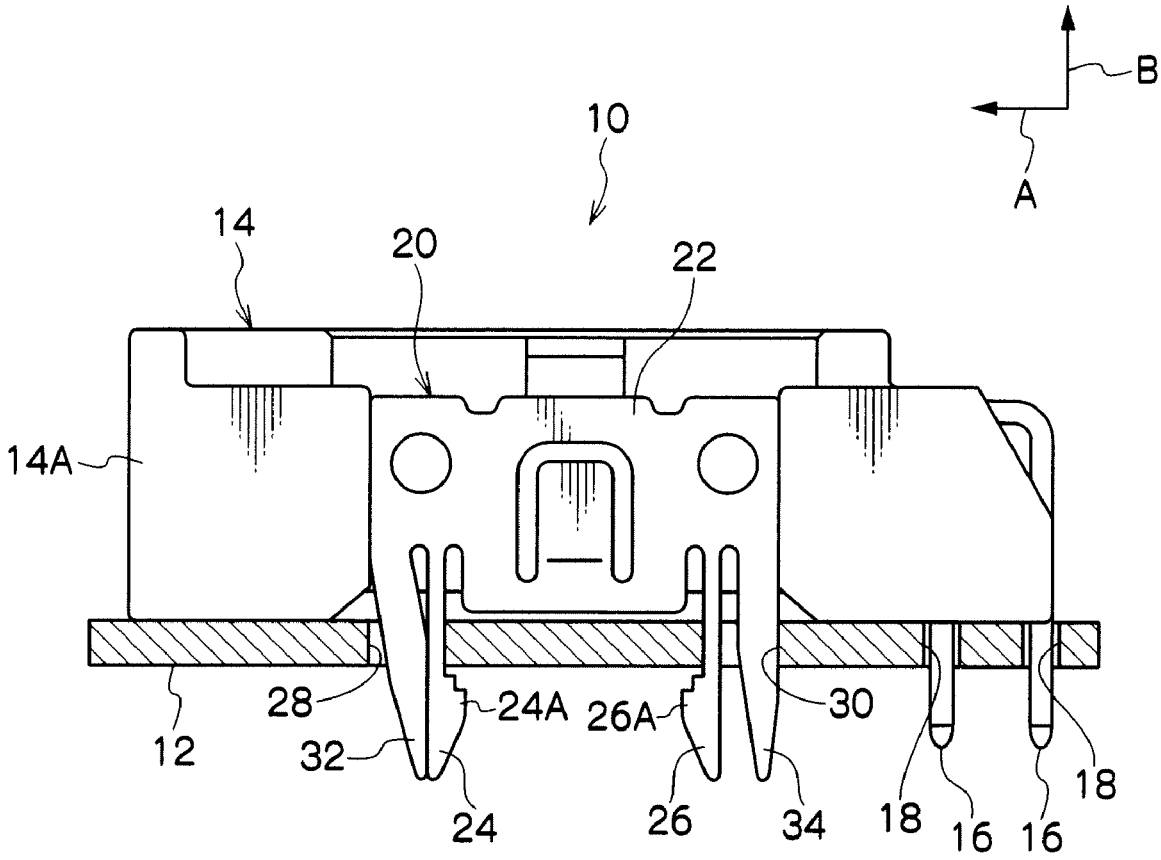
FIG. 3 is a cross-sectional drawing showing a state where the force-receiving rib of the connector according to the first exemplary embodiment is deformed.

On the other hand, when the above-described external force G is at or above a predetermined value, the force-receiving rib 32 deforms toward the rear side (i.e., toward the latching piece 24) due to the interference with the inner peripheral surface of the attachment hole 28 and latches (i.e., comes into contact) with the latching piece 24, as shown in FIG. 3. Due to this, deformation or flexure towards the front side of the latching piece 24 is restricted, and latching of the latching piece 24 (i.e., the state of being caught on the claw 24A) relative to the edge portion of the attachment hole 28 is maintained.

Additionally, except in the case when the connector main body 14 rotates relative to the substrate 12 as described above, in the case when the connector main body 14 is twisted three-dimensionally relative to the substrate 12 and an external force acts upon the force-receiving ribs 32, or in the case when a direct external force G acts upon the force-receiving ribs 32, the force-receiving ribs 32 deforms toward the side of the latching piece 24 and latches (i.e., comes into contact) therewith.

In the above-described state of temporary joining, when, for example, an external force in the direction of moving away from the substrate 12 is applied to the rear side of the connector main body 14, the force-receiving rib 34 generates resistance force that resists the external force. Further, when an external force of a predetermined strength or more is applied to the force-receiving rib 34 towards the latching piece 26 side, the force-receiving rib 34 deforms and latches with the latching piece 26, whereby deformation of the latching piece 26 is suppressed.

Next, function of the present exemplary embodiment will be explained.

In the connector 10 configured as described above, in a state of the connector main body 14 being temporarily joined with the substrate 12 by the latching pieces 24, 26 of the fixing clasp 20, when the external force F is applied to the front end side of the connector main body 14 in a direction separating away from the substrate 12, whose end portions in the width direction of the force-receiving rib 32 interferes with the inner peripheral surface of the attachment hole 28 and generates resistance force that resists the external force F. Accordingly, movement of the connector main body 14 away from the substrate 12 and deformation of the latching piece 24 due to the external force F is suppressed. Accordingly, the state of the above-described temporary joining by the connector main body 14 can be maintained.

Further, when the external force G that is applied to the force-receiving rib 32 due to interference with the inner peripheral surface of the attachment hole 28 is at or greater than a preset value, the force-receiving rib 32 deforms toward the latching piece 24 side and latches therewith. Due to this, deformation of the latching piece 24 is suppressed, and the state of latching of the latching piece 24 relative to the edge portion of the attachment hole 28 (i.e., the state of catching of the claw 24A) is maintained. Consequently, the above-described state of temporary joining by the latching piece 24 can be maintained.

Additionally, in the connector 10, the fixing clasp 20 is formed symmetrically at both sides in the front and rear directions so the same fixing clasp 20 can be used in the left side or the right side of the connector main body 14, and accordingly, increases in the number of parts can be prevented.

Although in the connector 10 according to the above-described embodiment, the f latching pieces 24, 26 and the force-receiving ribs 32, 34 are disposed on the fixing clasp 20 attached to the connector main body 14, the embodiment of the present invention is not limited to the above-mentioned exemplary embodiment. The present invention includes an embodiment having a configuration wherein both the latching piece 26 and force-receiving rib 34 are omitted.

Although the connector 10 according to the above-described exemplary embodiment is configured so that the force-receiving ribs 32, 34 have the width measurements L2 of the tip side thinner than the width measurement L1 of the base end side, a connector having a width measurements L2 of the tip end sides that are the same as the width measurements L1 of the base end sides are preferable in that the force-receiving ribs 32, 34 easily deform toward the latching pieces 24, 26.

What is claimed is:

1. A connector comprising:

a connector main body having opposing side walls and mounted on a substrate;

a latching piece that is attached to the connector main body and which has an outer edge that faces away from the nearest of said side walls of the connector main body and which temporarily joins the connector main body to the substrate by temporarily latching to an edge portion of an attachment hole formed in the substrate; and a rib which is stiffer than said latching piece and attached to the connector main body and adjacent to the latching piece, and which is inserted into the attachment hole, and having an edge portion in the width direction that interferes with an interior peripheral portion of the attachment hole that is opposite to said edge portion of said attachment hole when external force in a direction of moving away from the substrate acts on one end side of the connector main body so as to generate resistance force that resists the external force, wherein said rib edge portion engages said interior peripheral portion of the attachment hole throughout substantially all of a thickness of said substrate.

2. The connector of claim 1, wherein said latching piece includes a claw that latches a surface of said attachment hole when said latching piece is inserted through said attachment hole, and wherein said outer edge of said rib is substantially straight, and said rib has no latching claw.

3. The connector of claim 1, further comprising a second latching piece and a second rib adjacent thereto, both of which are attached to the connecter main body, wherein the second latching piece has an outer edge that faces away from the nearest of said side walls of the connector main body and which temporarily joins the connector main body to the substrate by temporarily latching to an edge portion of an attachment hole formed in the substrate; and the second rib has an edge portion in the width direction that interferes with an interior peripheral portion of the attachment hole that is opposite to said edge portion of said attachment hole when external force in a direction of moving away from the substrate acts on one end side of the connector main body so as to generate resistance force that resists the external force.

4. The connector of claim 1, wherein said rib that is attached to the connector main body deforms and latches with the latching piece when external force of a preset value or greater in a direction that moves toward the latching piece by itself is applied.

5. The connector of claim 4, wherein the rib is formed so that the width thereof is wider than the latching piece.

* * * * *